United States Patent [19]

Schiemann

[11] Patent Number: 4,889,255

[45] Date of Patent: Dec. 26, 1989

[54] DEVICE SUITABLE FOR USE AS A PLASTIC CAN

[76] Inventor: Wolfram Schiemann, Eugen-Nagele-Strasse 17, 7140 Ludwigsburg, Fed. Rep. of Germany

[21] Appl. No.: 252,529

[22] Filed: Oct. 3, 1988

[51] Int. Cl.[4] ..... B65D 11/00

[52] U.S. Cl. ..... 220/83; 220/4 E; 215/1 C

[58] Field of Search ..... 220/83, 22, 4 E, 4 B; 215/1 C

[56] References Cited

U.S. PATENT DOCUMENTS

| | | | |
|---|---|---|---|
| 3,176,879 | 4/1965 | Mojonnier | 220/4 E X |
| 3,744,656 | 7/1973 | Schiemann | 215/1 C X |
| 3,746,200 | 7/1973 | Flider | 215/1 C X |
| 4,609,106 | 9/1986 | Gentili | 215/1 C X |
| 4,781,314 | 11/1988 | Schoonover | 215/1 C X |
| 4,804,097 | 2/1989 | Alberghini et al. | 215/1 C X |
| 4,805,793 | 2/1989 | Brandt et al. | 215/1 C X |

*Primary Examiner*—Steven M. Pollard

[57] ABSTRACT

A device suitable for use as a plastic can, is essentially symmetrical to a plane separating two mould halves and features an outer wall, through which said separation plane runs. One or more projections are provided on each side of said separation plane, and the frontal face of said projection is separated from said separation plane. Viewed along the perpendicular to said separation plane, said projections are set off from one another so as not to overlap. The frontal face of said can features one or more projections that face said separation plane and are separated from said outer wall.

15 Claims, 4 Drawing Sheets

DEVICE SUITABLE FOR USE AS A PLASTIC CAN

The present invention relates to a device suitable for use as a plastic can, being essentially symmetrical to a plane separating two mold halves. Such a device has a frontal face and an outer wall through which the separation plane runs.

BACKGROUND OF THE INVENTION AND RELEVANT PRIOR ART

Such a can is known, for example, from German Patent 21 49 569. The present invention need not necesssarily relate, however, to a dual-chambered can. Such cans are sometimes employed where tools are used. The known dual-chambered can is frequently used by lumberjacks using chainsaws. In this case, the larger chamber is filled with gasoline, while the smaller chamber is filled with oil. The latter serves as motor oil and/or chain lubricant. Apart from his chainsaw, the forest worker must carry other tools such as a spark plug key. The latter is required because the saw operates under sometimes very poor conditions, which can lead to greasing of the spark plug. Such spark plug keys comprise a bar-like handle that is inserted through a pipe that is hexagonally shaped at one or both of its ends in order to accommodate the size of spark plug being used. Other auxiliary tools are used by the forest worker, such as dipsticks for measuring oil volume or tools or tightening the chain, etc.

OBJECT AND STATEMENT OF THE INVENTION

The object of the present invention is a simple means of permitting the forest worker to have his auxilliary tools ready for use at all times without having to carry them on his back, or using a separate tool box, etc. This object is accomplished in the present invention by the following means:

One or more projections are provided on each side of the separation plane, each having a face separated from the separation plane. Viewed along the perpendicular to the separation plane, the projections are set off from one another so as not to overlap. And, the projections are positioned on the frontal face of the can, face the separation plane and extend from the outer wall.

The invention provides blow-molded plastic cans and spun-cast plastic cans with a means of securing tools without using bars or rods. The wall of this kind of plastic can being between 2 and 3 mm.. thick, are sufficiently rigid to cause the projections to close together and secure the tool, after the latter is pressed into the space between the two frontal surfaces of the projections. The bulge dissipates the clamping forces over a relatively wide area of the outer wall, and can be considered as a further means of reinforcing the outer wall. Although bars are not attached to the plastic can after the molding operations, it is possible to design frontal surfaces and projections to secure different types of tools. Because the plastic can will be subjected to stringent strength testing, the outer wall is naturally produced from very tough materials, which, if used in the frontal surface, will not lose its clamping effect about the tool. The bulges can be easily produced with conventional equipment and do not require particular maintenance.

The described embodiment includes the following additional advantageous features:

Two of the projections are provided on one side of the separation plane, and one of the projections is provided on the other side of the separation plane. This permits the tool to be held between the projections alone, which in turn provides for ease of handling and transportation. It would also be entirely feasible to provide the can with only two projections, in which case the tool would have to be arranged to permit the clamping force provided by such projections to have the greatest effect by employing such projections as e.g. a stop.

Two of the projections are provided on one side of the separation plane, and two of the projections are provided on the other side of the separation plane. This provides for the even loading of the projections, all of which hold the tool in place in the same way.

Four projections are grouped into two groups, whereof one group is separated from the other by a distance that exceeds the distance of one of the projections in a group to another of the projections in the same group. This permits rod-like tools to be securely held in place by their end zones.

The projections have a length of 1–3 cm. in the longitudinal direction of the separation plane. This precludes non-uniform overloading of the synthetic material and allows the tool to be held over a greater portion of its length.

The can is a dual-chambered can with one chamber designated to hold oil, and the projections are arranged on the outer wall of the chamber designated to hold oil. This prevents the operation of forces that can cause the space between the projections to widen. Oil, as opposed to gasoline, does not produce vapor in warm temperatures, a condition which, applied to the can, precludes the bulging of the oil can wall and thus the attendant opening of the projections, which might well occur were the projections to be arranged on the wall of the can containing gasoline/high-octane gasoline/alcohol.

The projections are provided in the most distal zone of the frontal face. This ensures that the distance that the projections are forced apart during snapping is maximal, and that furthermore, long tool handles can be accommodated by such projections.

The projections is embodied as a flatish wart. This provides for the maintenance of the bulk of the projection and prevents it from wearing down. The distance through which the projections are forced apart when tools are snapped in and out is adequate but not excessive, and causes the projections themselves as well the outer wall to hardly move during this procedure.

The wart is elongated. This ensures that the tool is secured over a greater portion of its length.

The wart comprises an oval possessing one or more straight edges that run parallel to the outer wall in the zone of the separation plane. This permits the tool to be secured along a length suitable to prevent wear.

All projections, as viewed along a longitudinal direction, line up with each other, and all projections are of equal size. This simplifies the production of the blow-mold and allows rod-shaped tools having the same cross-sectional configurations to be held in place effectively.

The projections have, with the exception of the face, flat walls. This prevents the outer wall material from excessive stretching during blow-molding.

Each of the projections is at least a mirror-inverted likeness of the other. This further simplifies the production of the blowing mold; one need not be concerned about the ability of any particular projection to hold the tool.

The outer wall possesses a depression. The can has an uppermost projection and a neck suitable for pouring liquids, and the depression is arranged in the zone between the uppermost projection and the neck. This allows other parts of the tool to be secured to be placed at least partially in position, and, so as to prevent their being torn away, are not permitted to extend too far above the plastic can. Such indentations furthermore serve to reinforce the outer wall, particularly at points where the greatest forces are liable to impact during strength testing. In addition, it is not necessary for the user to stoop very far to separate tool from can, since the former can easily be grasped by its topmost part.

The depression is a groove running perpendicularly to the separation plane. This provides for a particularly simple projection that is suitable for securing e.g. spark plug keys.

DESCRIPTION OF THE DRAWINGS

The present invention will next be described in greater detail by means of drawings of a preferred embodiment, in which.

DETAILED DESCRIPTION OF A PREFERRED EMBODIMENT

Figure 2:
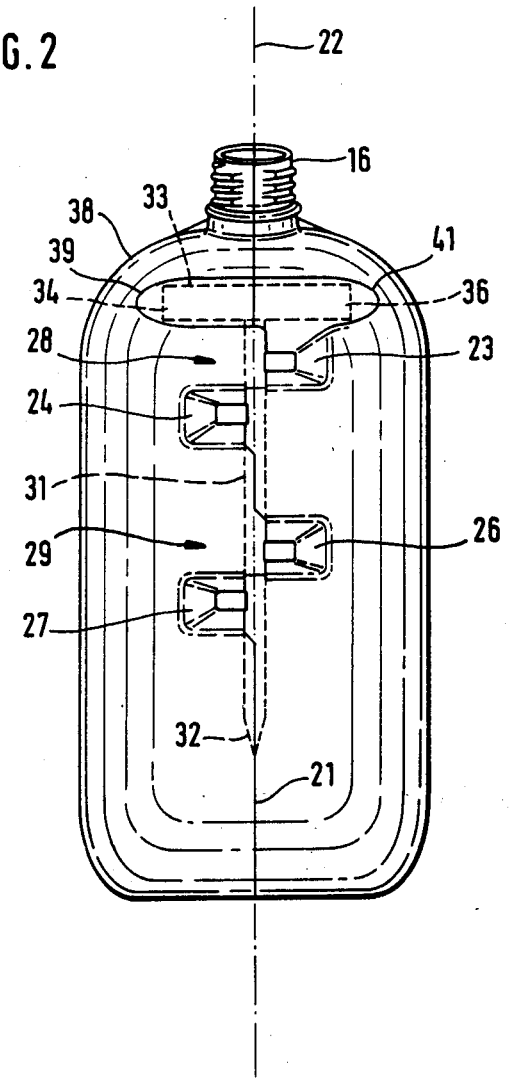
FIG. 2 is a view as indicated by arrow 2 of FIG. 1.
Figure 3:
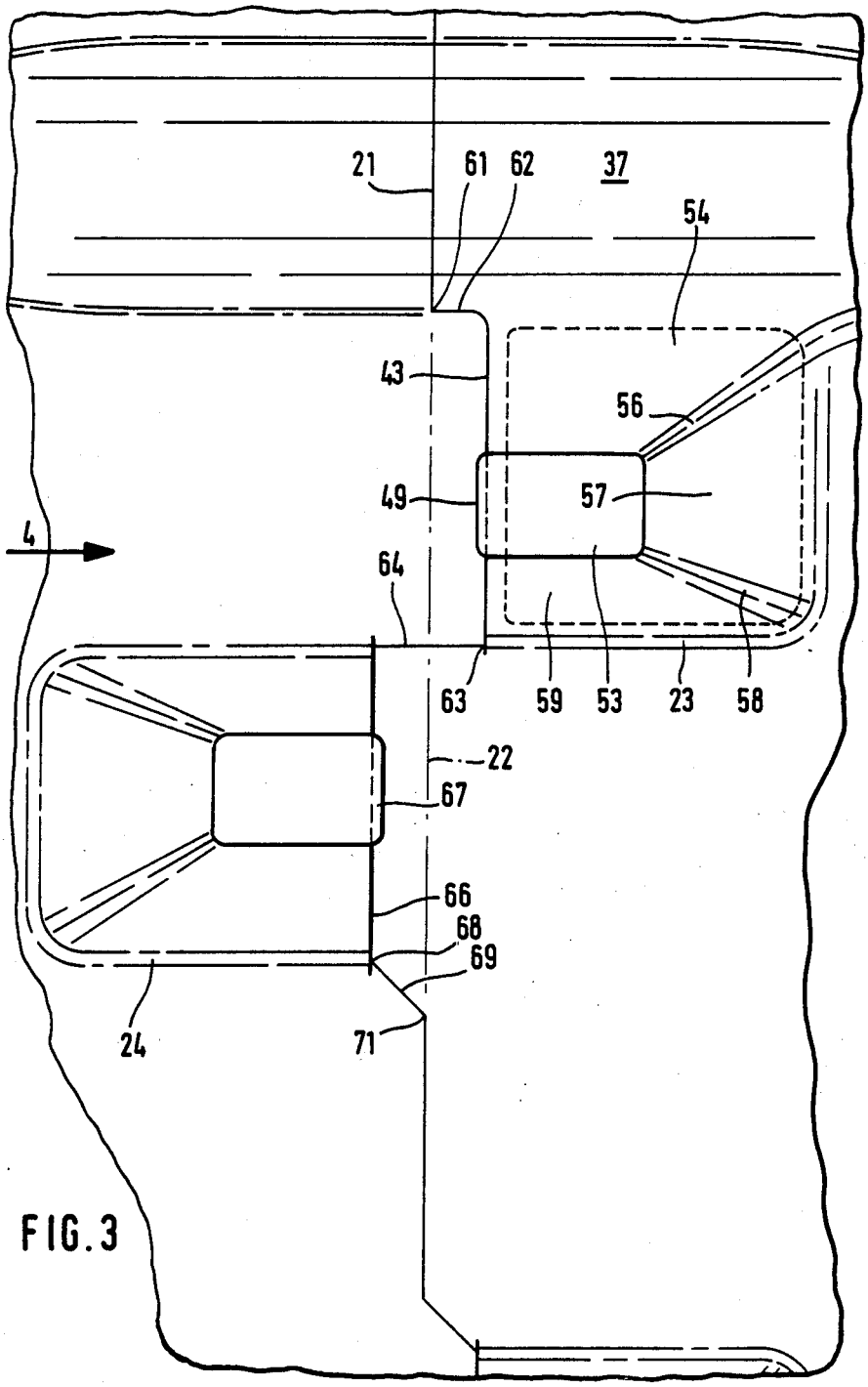
FIG. 3 is a broken away, enlarged view (compared to FIGS. 1 and 2) of an upper pair (projection and indentation).

A dual purpose can 11 that is blow-molded in plastic possesses a larger chamber 12 with a 5 liter capacity and a smaller chamber 13 with a 2.5 liter capacity. The larger chamber 12 has a threaded neck 14 and the smaller chamber 13 has a threaded neck 16. Located between these necks is a handle 17. The cans are joined together by means of a connecting member 18 that forms part of both cans. The wall thickness of dual purpose can 11 is approximately 2–3 mm. The same thickness applies to the outer wall 19 shown in FIG. 1 facing right and in FIG. 2 in a frontal view. Provided on the finished product in accordance with FIGS. 2 and 3 is a seam 21, which follows small but important variations in plane 22 that separates the two halves of the mold. These variations will be explained later on. Separation plane 22 corresponds to the separation plane 19 described in DE-AS 21 49 569. Outer wall 19 bears four projections 23, 24, 26, 27 of which 23 and 24 form a first group 28; projections 26 and 27 form a second group 29. The individual projections of each group lie close beneath or on top of one another. A space separates groups 28 and 29. The groups 28 and 29 are so closely spaced, however, that even a relatively short tool (such as handle 31 indicated by the broken line) can be held by these two groups of projections. Longer handles extend further downward than described in FIG. 2. Such a handle 31 is, for example, a rounded profile which, further down, becomes a screwdriver blade 32 that can be used to adjust the tension on power saw chains.

In the embodiment example shown, shaft 31 merges at the top into a tubular section 33, also indicated by a broken line, that serves as a handle that permits torque force to be applied through shaft 31 to screwdriver blade 32. Tubular section 33 has a hexagonal shape at its end zones 34, 36 which permits the tool to accomodate sparkplugs of various sizes. In the completed dual purpose can, tubular section 33 sits in a groove 37 that assumes and angle of 180° or less, runs perpendicular to separation plane 22, begins immediately above projection 23 and is located in cupola 38, into which outer wall 19 merges and which bears threaded neck 16. Groove 37 is, so to speak, an impression made in cupola 38, and since groove 37 assumes the shape of a spherical cylinder, semicircular areas 39, 41 are visible at the ends of groove 37. Projection 23 is not a solid mass, but comprises, in accordance with FIG. 4, 2–3 mm thick walls 42 formed by blow-moulding. Projection 23 has a left-facing frontal surface 43 which lies, in accordance with FIG. 3, a few millimeters to the right of separation plane 22 and runs essentially parallel to the latter.

The shape of the projection is defined by a first trapezoidal face 44 that slopes down to groove 37, a table-like face 46 that runs parallel to outer wall 19 in the zone of projection 23, a second trapezoidal face 47 sloping more steeply than trapezoidal face 44, and a wall-face 48.

Figure 4:
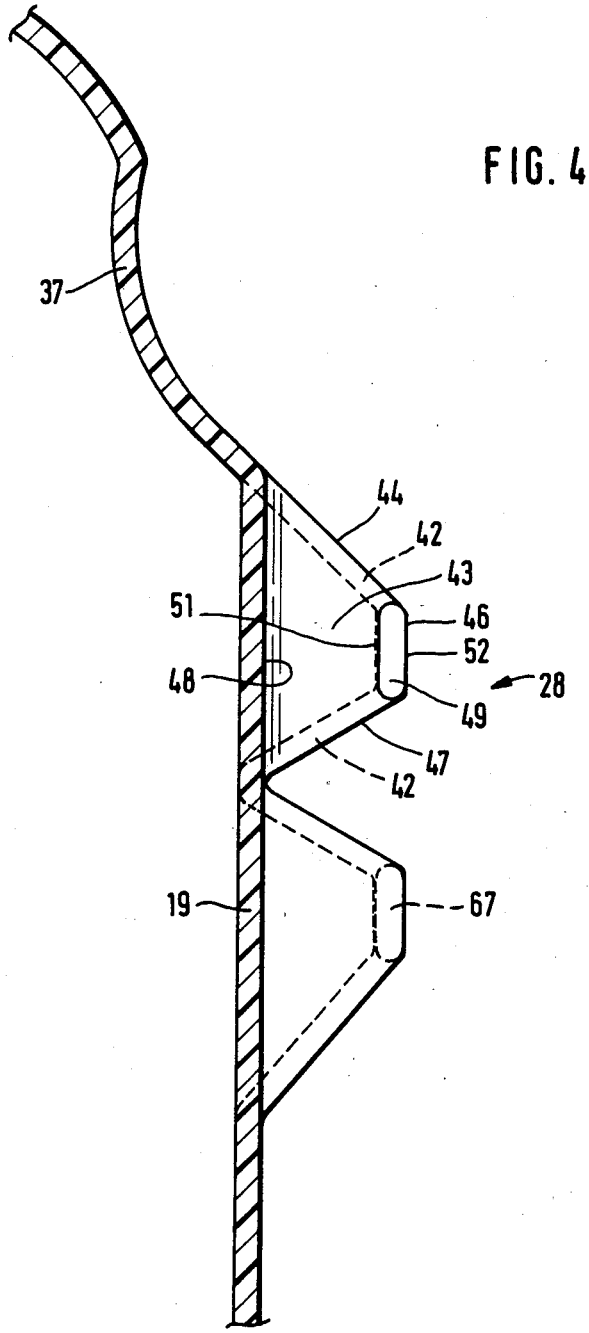
FIG. 4 is a view as indicated by arrow 4 of FIG. 3.

The resulting structure is, according to FIG. 4, an unequally-sided trapezoid that more or less falls away to the bottom. In accordance with FIG. 4, an oval 49 is situated to the left of table edge 46, whose perpendicularly-oriented edges 51, 52 run parallel to outer wall 19 in this zone. Edge 52 merges with table edge 46 when viewed as in FIG. 4. Oval 49 is less than 1 mm thick, as seen from the direction shown in FIG. 3. Because the thickness of oval 49 corresponds to that of walls 42, it can easily be supported upon the latter. Viewed from the direction given in FIG. 3, projection 23 appears as a mesa-like structure. Situated on the top is the more or less rectangular table 53 from which a wall section 54 ascends toward the top, being bounded on the left by frontal face 43 and on the right by a bend 56. A wall section 57, sloping away from table 53, is bounded at the 1:30 o'clock position by a bend 56 that extends from the upper right hand corner of table 53. Toward the bottom, wall section 57 is bounded by a bend 58 that extends from the lower right-hand corner of table 53 and occupies the 4:30 o'clock position. The structure is completed by a steep wedge-like wall 59. The result is a structure that is easily produceable using conventional moulds and blow moulding techniques. Because frontal face 43 lies to the right of separation plane 22, seam 21 turns right at a 90° angle 61 along section 62 to projection 23, runs along trapezoidal face 44, then becomes table edge 46, turns to follow trapezoidal face 47, and returns to the left at a 90° angle 63 and then crosses, as section 64, separation plane 22, whereby section 64 is twice the length of section 62.

Figure 1:
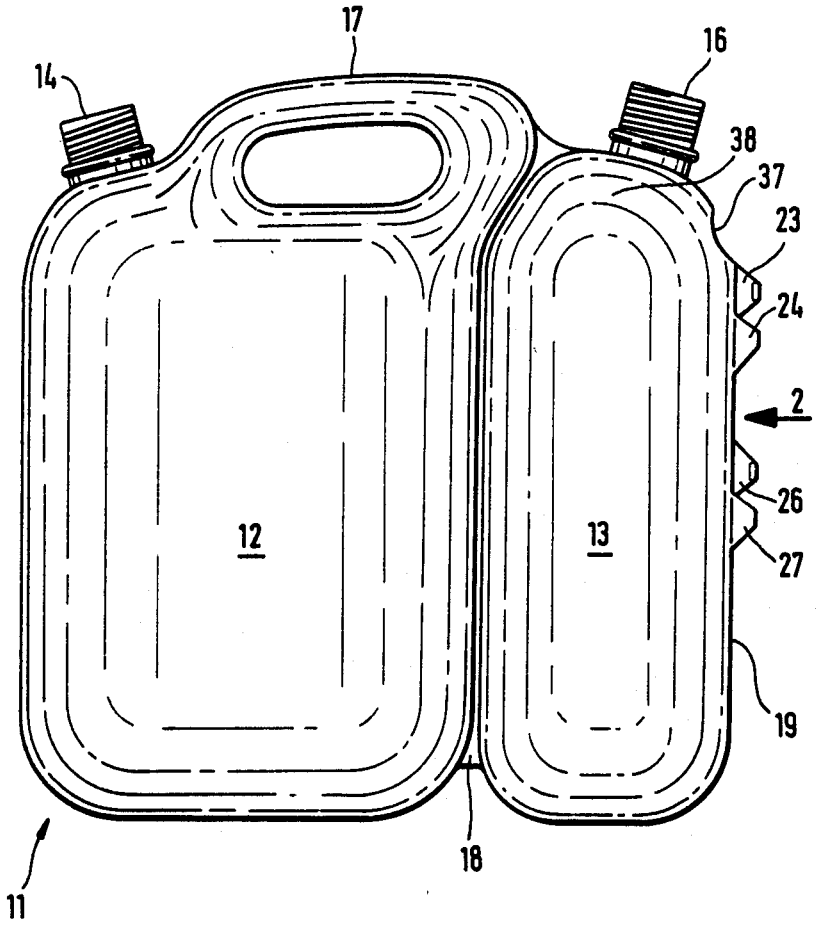
FIG. 1 is a lateral view of a dual-chambered can.

The implication of this arrangement for the mould employed in this case is that the form for the front half section of the double can, according to FIG. 1, protrudes between sections 62 and 64 towards the right across separation plane 22 and bears the reverse form of frontal face 43 together with oval 49. The above description of projection 43 obviates the need for a separate detailed description of projection 24. The latter has, in accordance with FIG. 3, a left-facing frontal face 66, which, in accordance with FIG. 4 possesses a shape that is the mirror-image of frontal face 43 and bears right-facing oval 67. This structure is formed by seam 21 becoming section 64, which follows the corresponding trapezoidal edge of frontal face 66, bends 135° at 68 to become section 69, which continues with a 135° bend 71 as separation plane 22. These zones to the left of separation plane 22 belong, in accordance with FIG. 3, to the right hand half of the mould, which thus forms the right hand section of groove 37, wall sections 54, 57 and 59 as well as frontal surface 68 and oval 67.

Because the lower group 29 is formed in the same way, it need not be described in further detail.

All figures have been drawn to scale, and exhibit other features that have not been described in the present application.

The embodiments of the invention in which an exclusive property of privilege is claimed are defined as follows:

1. Device suitable for use as a multi-chambered plastic can, being essentially symmetrical to a plane separating two mold halves, said device having a frontal face and an outer wall through which said separation plane runs, wherein:

(a) at least two projections are provided on one side of said separation plane, and at least one projection is provided on the other side of said separation plane;

(b) viewed along the perpendicular to said separation plane, said projections are set off from one another so as not to overlap; and (c) said projections are positioned on said frontal face of said can, face said separation plane and extend from said outer wall said projections being adapted to hold a tool therebetween.

2. Device in accordance with claim 1, wherein two of said projections are provided on one side of said separation plane, and two of said projections are provided on the other side of said separation plane.

3. Device in accordance with claim 2, wherein said four projections are grouped into two groups, whereof one groups is separated from the other by a distance that exceeds the distance of one of said projections in a group to another of said projections in the same group.

4. Device in accordance with claim 1, wherein said projections have a length of 1-3 cm in the longitudinal direction of said separation plane.

5. Device in accordance with claim 1, wherein said can is a dual-chambered can with one chamber designated to hold oil, and said projections are arranged on the outer wall of said chamber designated to hold oil.

6. Device in accordance with claim 1, wherein said projections are provided in the most distal zone of said frontal face.

7. Device in accordance with claim 1, wherein said projection is embodied as a flatish wart.

8. Device in accordance with claim 7, wherein said wart is elongated.

9. Device in accordance with claim 8, wherein said wart comprises an ovall possessing one or more straight edges that run parallel to said outer wall in the zone of said separation plane.

10. Device in accordance with claim 1, wherein all said projections, as viewed along a longitudinal direction, line up with each other, and all said projections are of equal size.

11. Device in accordance with claim 1, wherein said projections have, with the exception of said face, flat walls.

12. Device in accordance with claim 1, wherein each of said projections is at least a mirror-inverted likeness of the other.

13. Device in accordance with claim 1, wherein said outer wall possesses a depression.

14. Device in accordance with claim 13, wherein said can has an uppermost projection and a neck suitable for pouring liquids, and said depression is arranged in the zone between said uppermost projection and said neck.

15. Device in accordance with claim 13, wherein said depression is a groove running perpendicularly to said separation plane.

* * * * *